United States Patent [19]

Neuhold

[11] 4,312,456

[45] Jan. 26, 1982

[54] ROPEWAY CRANE

[75] Inventor: Heimo Neuhold, Kärnten, Austria

[73] Assignee: Reinhold Hinteregger Maschinen- und Seilbahnbau, Villach, Austria

[21] Appl. No.: 158,177

[22] Filed: Jun. 10, 1980

[30] Foreign Application Priority Data

Jun. 11, 1979 [AT] Austria ..... 4158/79

[51] Int. Cl.[3] ..... B66C 11/20

[52] U.S. Cl. ..... 212/96

[58] Field of Search ..... 212/87, 89, 91, 94, 212/96, 99

[56] References Cited

U.S. PATENT DOCUMENTS 3,712,478 1/1973 Rennie et al. ..... 212/89

*Primary Examiner*—Robert G. Sheridan

*Attorney, Agent, or Firm*—Martin A. Farber

[57] ABSTRACT

A running gear is guided by a carrying rope and movable along the same. A crane housing is connected to said running gear. A pullback rope is secured to the crane housing and operable to pull said crane housing along said carrying rope. A lifting rope pulley formed with a peripheral groove is mounted on a shaft which is mounted in said crane housing. A lifting rope trained around said lifting rope pulley in said groove is adapted to be paid out from said lifting rope pulley by a rotation of the latter in a predetermined sense. A storage drum is mounted on said shaft and non-rotatably connected to said lifting rope pulley. A payout rope is wound on said storage drum and operable to be unwound from said storage drum so as to rotate the same in said predetermined sense. At least one pressure roller is associated with said lifting rope in said groove. Pressure-applying means are provided for forcing said pressure roller against said lifting rope in said groove. Drive means are provided for positively driving said pressure roller at a peripheral velocity which is equal to the peripheral velocity of said lifting rope in said groove as said payout rope is unwound from said storage drum.

6 Claims, 2 Drawing Figures

ROPEWAY CRANE

Figure 1:
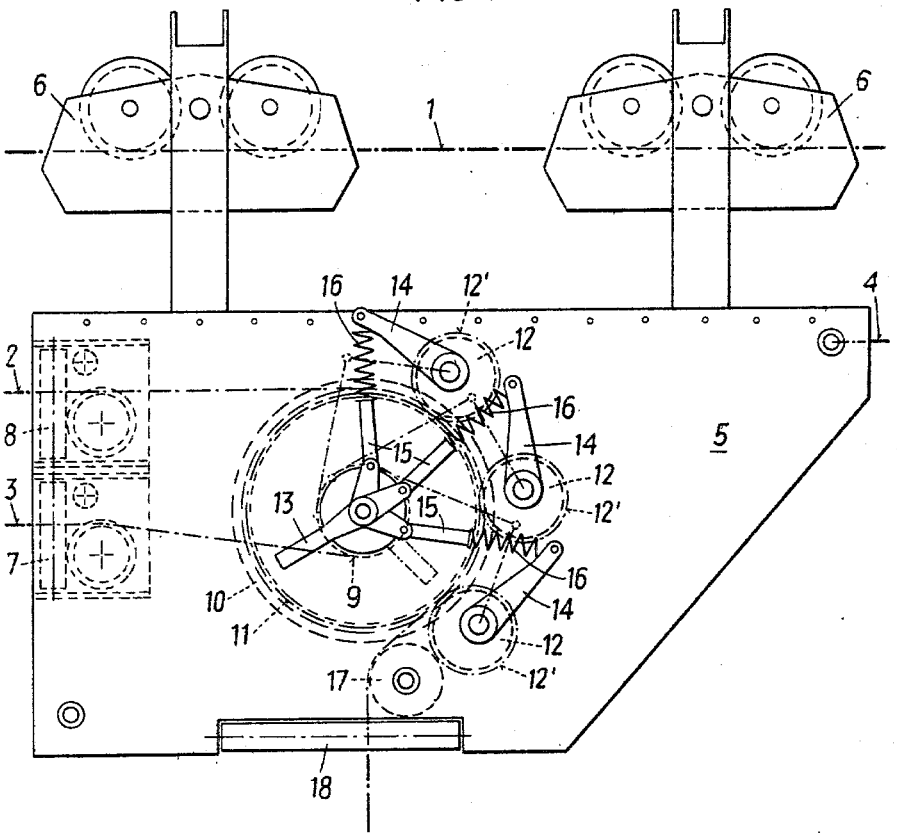

This invention relates to a ropeway crane comprising a crane housing, which by means of a running gear is movable along a carrying rope, a pullback rope secured to the crane housing, a lifting rope pulley and a payout rope storage drum which are mounted in the crane housing on a common shaft for joint rotation.

In those ropeway cranes, in which the lifting rope is paid out in that the payout rope is unwound from its storage drum, the difficulty arises that particularly when the ropeway crane is a relatively large distance apart from its driving machine the lifting rope pulley may slip relative to the lifting rope because the weight of the lifting rope between the driving machine and the ropeway crane overcomes the frictional force which acts between the lifting rope pulley and the lifting rope.

This problem arises also in the ropeway crane which is known from U.S. Pat. No. 3,712,478 which comprises pressure rollers for the lifting rope. Whereas these pressure rollers are urged by a spring against the lifting rope trained around the lifting rope pulley, the pressure rollers are not positively connected to the lifting rope pulley so that they are not positively driven and act as snubbing rather than as clamping rollers.

It is an object of the invention to provide a ropeway crane which is of the kind described first hereinbefore and in which said disadvantage does not arise.

In accordance with the invention this is accomplished in that the lifting rope in the groove of the lifting rope pulley is engaged by at least one pressure roller, which forces the lifting rope into the groove and which may be disengageable, if desired, and that the pressure roller is positively driven at a peripheral velocity which is equal to the peripheral velocity of the lifting rope in the groove of the lifting rope pulley.

Any slip between the lifting rope pulley and the lifting rope is avoided as a result of the provision of the pressure roller, or of a plurality of pressure rollers provided in ropeway cranes having a large span. The pressure roller and the lifting rope pulley cooperate like clamping rollers so that the lifting rope will be reliably paid out. A crane hook may be secured to the lifting rope.

The pressure roller can be positively driven in various ways with the desired synchronism. For instance,- the lifting rope pulley and the pressure roller may be connected by chains, ribbed belts or the like. In a preferred embodiment of the invention, the means for positively driving the pressure roller comprise a gear, which is carried by the lifting rope pulley, and a pinion, which is non-rotatably connected to the pressure roller and in mesh with the gear, and the pitch circle diameter of the gear is as large as the diameter of the curvature of the lifting rope in the groove of the lifting pulley. That embodiment ensures a slip-free drive of the pressure roller with the desired synchronism and permits a lifting of the pressure roller from the groove in the lifting rope pulley when the lifting rope is to be pulled back.

Also within the scope of the invention, the pressure roller may be eccentrically mounted on a lever which is pivoted to the crane housing and engaged at its free end by a prestressable compression spring, which is supported in the crane housing and forces the pressure roller against the lifting rope in the groove of the lifting rope pulley.

In a particularly desirable embodiment, the pressure roller can be disengaged from the lifting rope in the groove of the lifting rope pulley in that a shifting lever engaging the compression spring is pivotally moved to one end position, and the compression spring is arranged to be prestressed in that the shifting lever is moved to its other end position. When there are a plurality of pressure rollers, a single shifting lever may be provided for actuating all compression springs and pressure rollers.

Figure 2:
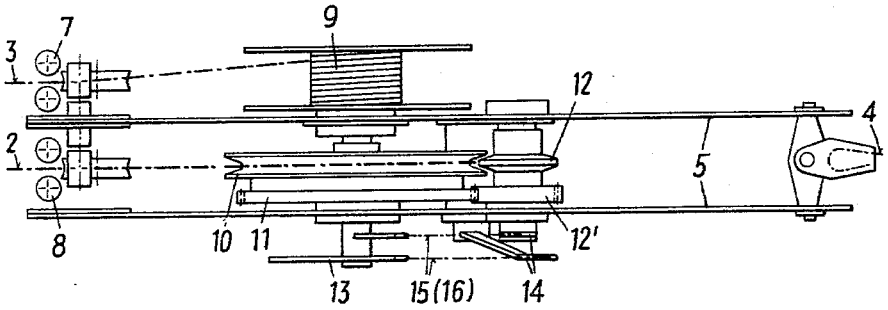

Further details and advantages of the invention will become apparent from the following description of a preferred embodiment of the invention which is shown on the drawing, in which FIG. 1 is a side elevation showing a ropeway crane and FIG. 2 is a top plan view showing the ropeway crane of FIG. 1.

The ropeway crane shown in the drawing is a downhill ropeway crane and comprises a crane housing 5, which is guided along a carrying rope 1 by two running gears 6 and is movable along the carrying rope 1 by means of a pullback rope 4 that is secured to the crane housing. The crane housing 5 may consist, for instance, of two spaced apart beams. A shaft is mounted in the crane housing 5. A lifting rope pulley 10 and a storage drum 9 are carried by and non-rotatably connected to the shaft. A lifting rope 2 is trained around the lifting rope pulley 10 and guided by lead-in rollers 8. A payout rope 3 is wound on the storage drum and is also guided by lead-in rollers 7.

In the embodiment shown by way of example, three pressure rollers 12 engage the lifting rope 2 in the groove of the lifting rope pulley 10 and are forced against the lifting rope 2 by compression springs 16 through the intermediary of one-armed levers 14, which are pivoted in the housing 5 and are movable by a common shifting lever 13 to a position in which the springs 16 are prestressed.

The number of pressure rollers 12 depends on the desired lifting height and on the length of the lifting rope between the driving machine and the ropeway crane. Pinions 12' are non-rotatably connected to the pressure rollers 12 and rotatably mounted in the levers 14 and in mesh with a gear 11, which is non-rotatably connected to the lifting rope pulley 10. The pitch circle diameter of the gear 11 is equal to the diameter of the curvature of the lifting rope 2 in the groove of the lifting rope pulley 10. This is particularly apparent from FIG. 2.

From FIG. 1 it is also apparent that the shifting lever 13 is movable to the position indicated by dash-dot lines in order to lift the pressure rollers 12 out of the groove of the lifting rope pulley 10 so that the lifting rope 2 can then be pulled back into the ropeway crane. Guide plates, not shown, are provided between the pressure rollers 12 in order to facilitate the pulling back of the lifting rope.

For the use of the ropeway crane shown on the drawing, the same is pulled uphill by the pullback rope 4 to the desired position while the lifting rope 2 and the payout rope 3 and paid out by the supply drums on the drive machine, which is not shown.

The winch for the pullback rope 4 is stopped when the crane has reached the desired position. The drum provided in the drive machine for the payout rope 3 is then operated to cause the rope to be unwound from the storage drum 9 so that the lifting rope pulley 10 is driven and the pressure rollers 12 are driven by the gear 11 of the lifting rope pulley and the pinions 12'. Under the action of the compression springs 16, which are prestressed by the shifting lever 13 and the shifting linkage 15, the pressure rollers exert pressure on the lifting rope 2 so that the latter is frictionally driven and paid out. As soon as the hook secured to the lifting rope has reached its lower end position, the payout operation of the payout rope is terminated. The lifting rope is subsequently lifted while the payout rope 3 is wound onto its storage drum 9. Finally the hook secured to the lifting rope 2 reaches its upper end position, in which said hook may engage the lead-in rollers 18.

Because the lifting rope 2, the payout rope 3 and pullback rope 4 are moved in synchronism, the ropeway crane can be moved uphill or downhill as desired.

The axes of the pressure rollers 12 are offset from the pivotal axes of the levers 14. For this purpose, e.g., the shafts which are mounted in the crane housing 5 and to which the levers 14 are secured may have an eccentric portion so that these shafts constitute crankshafts. The pressure rollers 12 and the pinions 12' are then mounted on said offset or eccentric portion.

What is claimed is:

1. In a ropeway crane, comprising a carrying rope, a running gear guided by and movable along said carrying rope, a crane housing connected to said running gear, a pullback rope secured to said crane housing and operable to pull the latter along said carrying rope, a shaft mounted in said crane housing, a lifting rope pulley formed with a peripheral groove and mounted on said shaft, a lifting rope trained around said lifting rope pulley in said groove and adapted to be paid out from said lifting rope pulley by a rotation of the latter in a predetermined sense, a storage drum mounted on said shaft and nonrotatably connected to said lifting rope pulley, and a payout rope wound on said storage drum and operable to be unwound from said storage drum so as to rotate the same in said predetermined sense, the improvement residing in that at least one pressure roller is associated with said lifting rope in said groove, pressure-applying means are provided for forcing said pressure roller against said lifting rope in said groove, and drive means are provided for positively driving said pressure roller at a peripheral velocity which is equal to the peripheral velocity of said lifting rope in said groove as said payout rope is unwound from said storage drum.

2. The improvement set forth in claim 1, in which a plurality of pressure rollers are associated with said lifting rope in said groove, pressure-applying means are provided for forcing said pressure rollers against said lifting ropes in said groove, and drive means are provided for positively driving each of said pressure rollers at a peripheral velocity which is equal to the peripheral velocity of said lifting rope in said groove as said payout rope is unwound from said storage drum.

3. The improvement set forth in claim 1, which comprises disengaging means for disengaging said pressure roller from said lifting rope in said groove and from said lifting rope pulley.

4. The improvement set forth in claim 1, in which said drive means comprise a gear which is non-rotatably connected to said lifting rope pulley and has a pitch circle diameter which is equal to the diameter of the curvature of said lifting rope in said groove and a pinion which is non-rotatably connected to said pressure roller and in mesh with said gear.

5. The improvement as set forth in claim 1, in which said pressure-applying means comprise a lever, which is pivoted in said crane housing and has a free end, and a prestressable compression spring which is supported against said crane housing and bears on said free end of said lever, said pressure roller is eccentrically mounted in said lever, and said compression spring urges said pressure roller towards said lifting rope in said groove.

6. The improvement set forth in claim 5, in which said pressure-applying means comprise a shifting lever, which is connected to said compression spring and is pivotally movable between first and second positions, said shifting lever being arranged to prestress said compression spring as said shifting lever is moved to said first position and to disengage said pressure roller from said rope in said groove and from said lifting rope pulley as said shifting lever is moved to said second position.

* * * * *